US010234116B2

(12) United States Patent
Maguire

(10) Patent No.: US 10,234,116 B2
(45) Date of Patent: Mar. 19, 2019

(54) SOLAR-POWERED LANTERN HAVING COLLAPSIBLE SHADE STRUCTURE

(71) Applicant: Evergreen Enterprises of Virginia, LLC, Richmond, VA (US)

(72) Inventor: Paul Maguire, Goochland, VA (US)

(73) Assignee: Evergreen Enterprises of Virginia, LLC, Richmond, VA (US)

( * ) Notice: Subject to any disclaimer, the term of this patent is extended or adjusted under 35 U.S.C. 154(b) by 0 days.

(21) Appl. No.: 15/386,914

(22) Filed: Dec. 21, 2016

(65) Prior Publication Data

US 2018/0172252 A1 Jun. 21, 2018

(51) Int. Cl.

| | |
|---|---|
| ***F21V 1/06*** | (2006.01) |
| ***F21L 4/08*** | (2006.01) |
| ***F21V 21/14*** | (2006.01) |
| ***F21V 17/18*** | (2006.01) |
| ***F21V 23/04*** | (2006.01) |
| ***F21V 21/40*** | (2006.01) |
| *F21Y 115/10* | (2016.01) |

(52) U.S. Cl.

CPC ..... *F21V 21/14* (2013.01); *F21L 4/08* (2013.01); *F21V 17/18* (2013.01); *F21V 21/406* (2013.01); *F21V 23/0414* (2013.01); *F21Y 2115/10* (2016.08)

(58) Field of Classification Search

CPC ..... F21L 4/04; F21L 4/08; F21V 1/06; F21V 17/00; F21V 21/145; F21V 21/32

See application file for complete search history.

(56) References Cited

U.S. PATENT DOCUMENTS

| | | | | | |
|---|---|---|---|---|---|
| 872,792 | A | * | 12/1907 | Boyle | B65D 7/20 217/52 |
| 1,454,388 | A | * | 5/1923 | Waldemar | A47J 47/18 15/DIG. 9 |
| 1,868,692 | A | * | 7/1932 | Bruckmann | F21V 1/00 362/357 |
| 1,990,804 | A | * | 2/1935 | Watson | E04H 1/1244 135/128 |
| 3,014,516 | A | * | 12/1961 | Mueller | B65D 37/00 138/131 |
| 3,180,982 | A | * | 4/1965 | Derman | F21V 1/06 362/450 |
| 4,167,034 | A | * | 9/1979 | Noguchi | F21S 6/002 362/277 |
| 5,424,928 | A | | 6/1995 | Jordan et al. | |
| 5,791,773 | A | * | 8/1998 | Babineaux | F21V 1/06 362/16 |

(Continued)

*Primary Examiner* — Ismael Negron

(74) *Attorney, Agent, or Firm* — Jordan IP Law, LLC; Todd A. Vaughn

(57) ABSTRACT

A portable and expandable solar-powered lantern that includes a light source, at least one solar panel in electrical communication with a battery to power the light source, and a self-erecting coil structure defining a frame covered by a compliant shade member. The frame includes an inner coil member coiled in a first direction relative to the longitudinal axis of the frame, and an outer coil member coiled in a second direction opposite to the first direction. The coil structure is moveable between a collapsed storage position and an expanded position, the compliant shade member limiting the length of the frame when the coil structure is in the expanded position.

11 Claims, 12 Drawing Sheets

(56) References Cited

U.S. PATENT DOCUMENTS

| | | | | |
|---|---|---|---|---|
| 5,960,983 | A * | 10/1999 | Chan | B65F 1/02 220/489 |
| 6,520,365 | B2 * | 2/2003 | Schneider | A45C 7/0077 220/666 |
| 6,554,149 | B2 * | 4/2003 | Schneider | A45C 7/0077 220/666 |
| D486,272 | S * | 2/2004 | Donegan | D30/124 |
| 7,513,638 | B2 * | 4/2009 | Allsop | F21S 9/037 362/183 |
| 7,857,490 | B1 * | 12/2010 | Fett | F21V 3/026 362/351 |
| 8,192,044 | B2 | 6/2012 | Allsop et al. | |
| 8,206,003 | B1 * | 6/2012 | LaBarge | F21L 4/08 206/389 |
| 8,657,461 | B2 | 2/2014 | Allsop et al. | |
| 9,109,778 | B2 * | 8/2015 | Cohen | F21V 1/06 |
| D747,023 | S | 1/2016 | Coughlin et al. | |
| 9,255,675 | B1 * | 2/2016 | Salzinger | H05B 37/0218 |
| 9,631,800 | B2 * | 4/2017 | Coughlin | F21V 21/14 |
| 9,932,752 | B1 * | 4/2018 | Vila | A45F 3/02 |
| 2005/0105293 | A1 * | 5/2005 | Hsu | F21V 1/06 362/352 |
| 2007/0236922 | A1 * | 10/2007 | Sheehan | A63H 37/005 362/162 |
| 2014/0118997 | A1 * | 5/2014 | Snyder | F21S 9/037 362/183 |
| 2015/0077980 | A1 | 3/2015 | Coughlin et al. | |
| 2015/0359190 | A1 * | 12/2015 | Chylinski | A01K 5/01 119/60 |

* cited by examiner

SOLAR-POWERED LANTERN HAVING COLLAPSIBLE SHADE STRUCTURE

TECHNICAL FIELD

Embodiments relate to a lighting device configured to emit light, and particularly, to a self-deploying portable lantern that may be manipulated from a collapsed storage position to an expanded, deployed position.

BACKGROUND

Lighting devices such as lanterns may be utilized to illuminate certain areas of the home, such as interior spaces, patios, and outdoor lawns. Such lanterns are in an expanded position when in active use, and may be manipulated to a collapsed position for purposes of storage.

DRAWINGS

Figure 4:
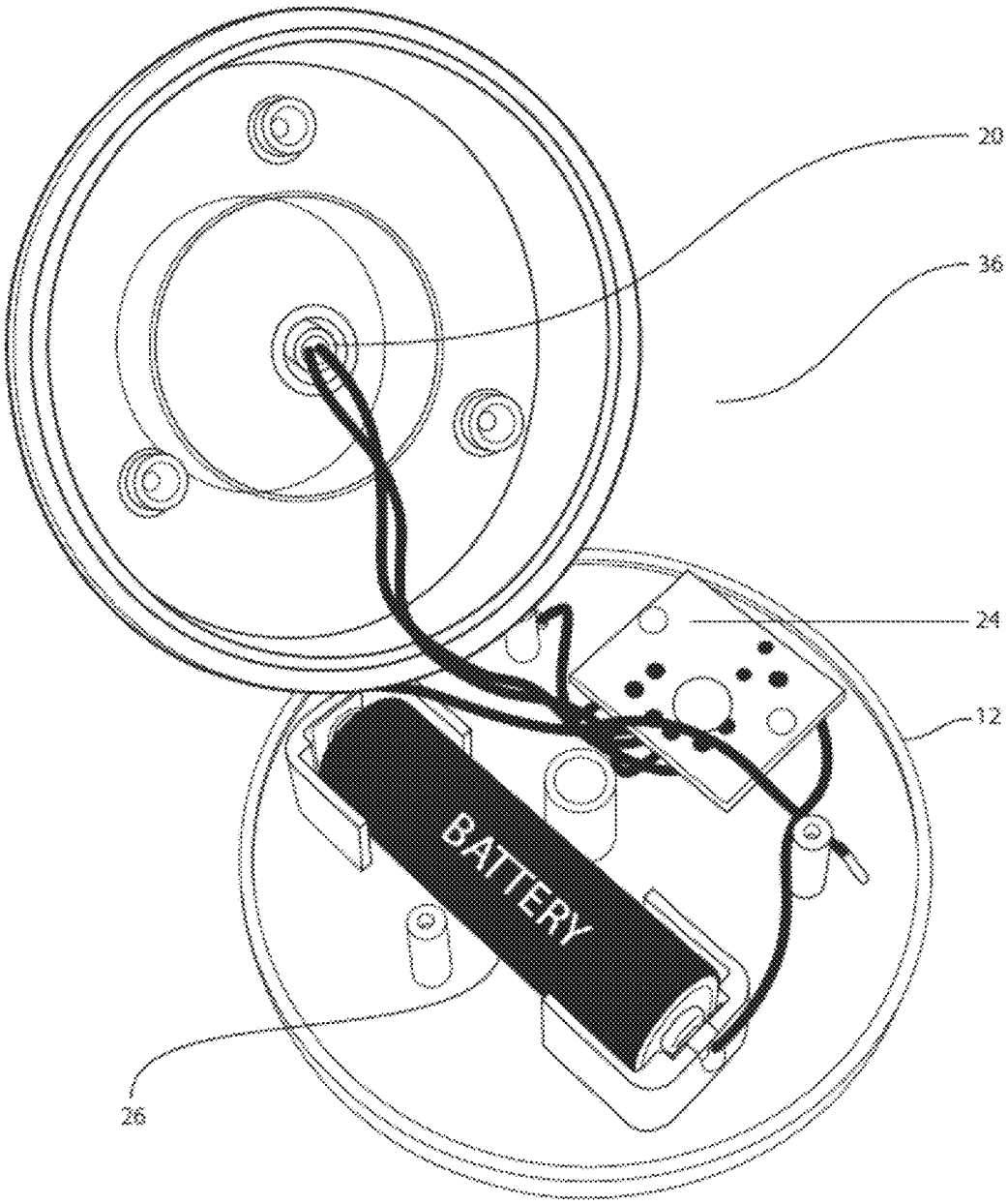

FIG. 4. illustrates a view of the components of a solar panel assembly of a lantern, in accordance with embodiments.

Figure 5:
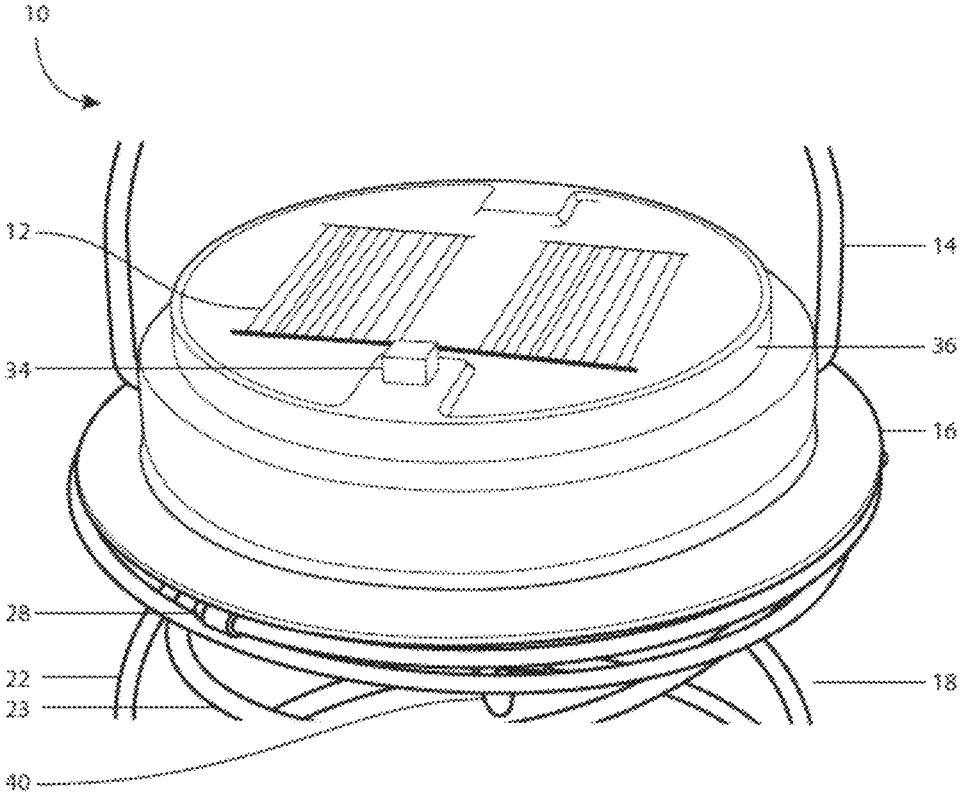

FIG. 5 illustrates a top perspective view of the solar circuit housing of a solar-powered lantern, in accordance with embodiments.

Figure 6:
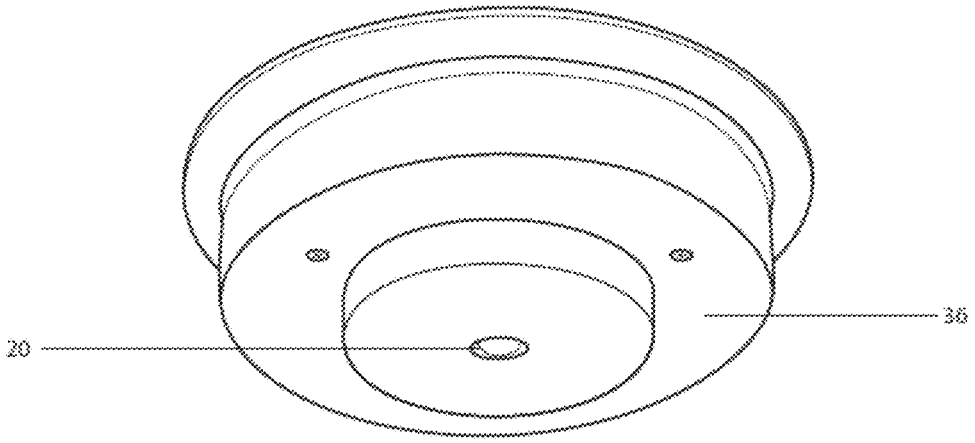

FIG. 6 illustrates a bottom perspective view of the solar circuit housing received in the housing of the lantern, in accordance with embodiments.

Figure 1:
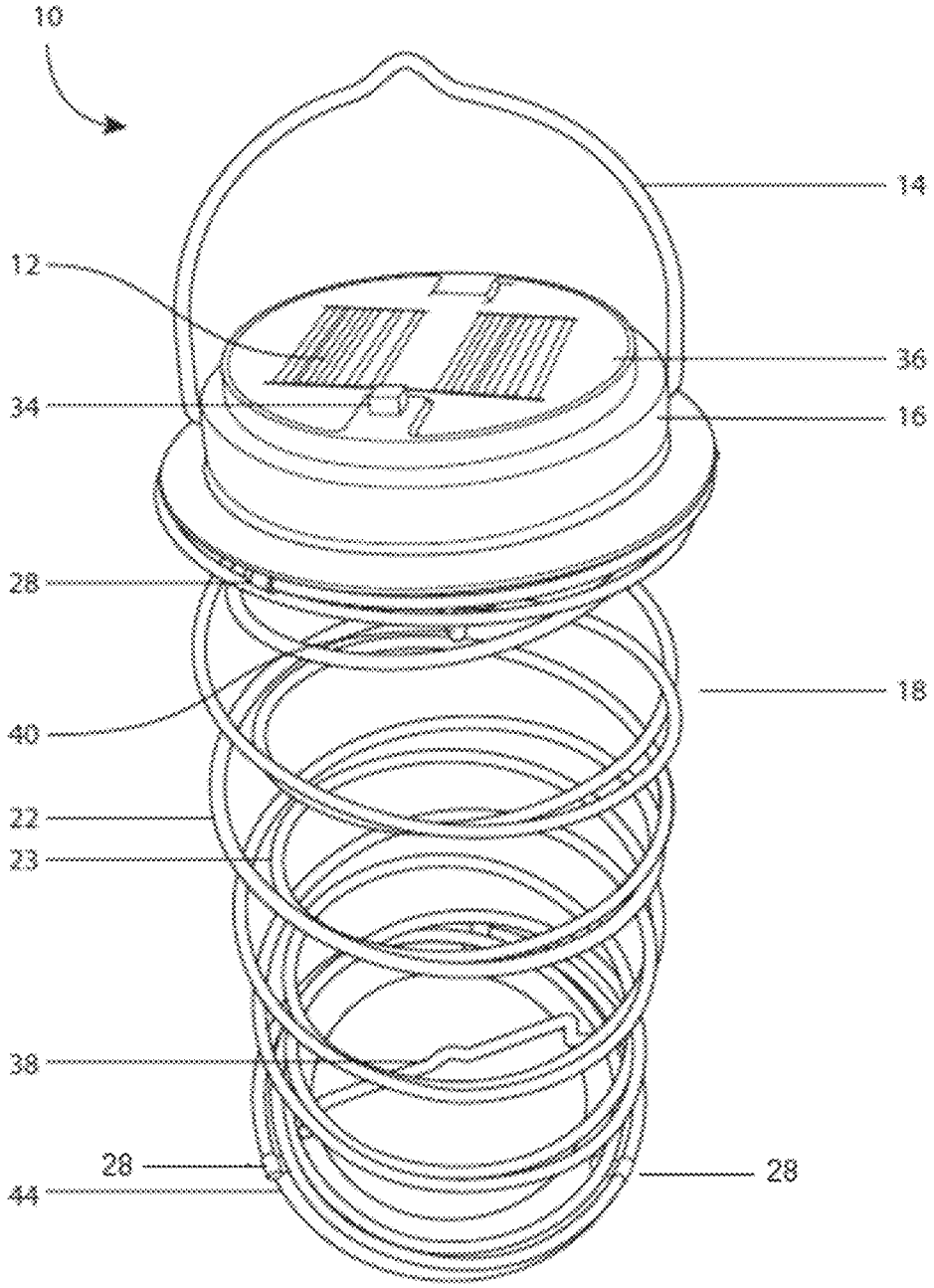
FIG. 1 illustrates a perspective view of a lantern in an expanded position, in accordance with embodiments.
Figure 2:
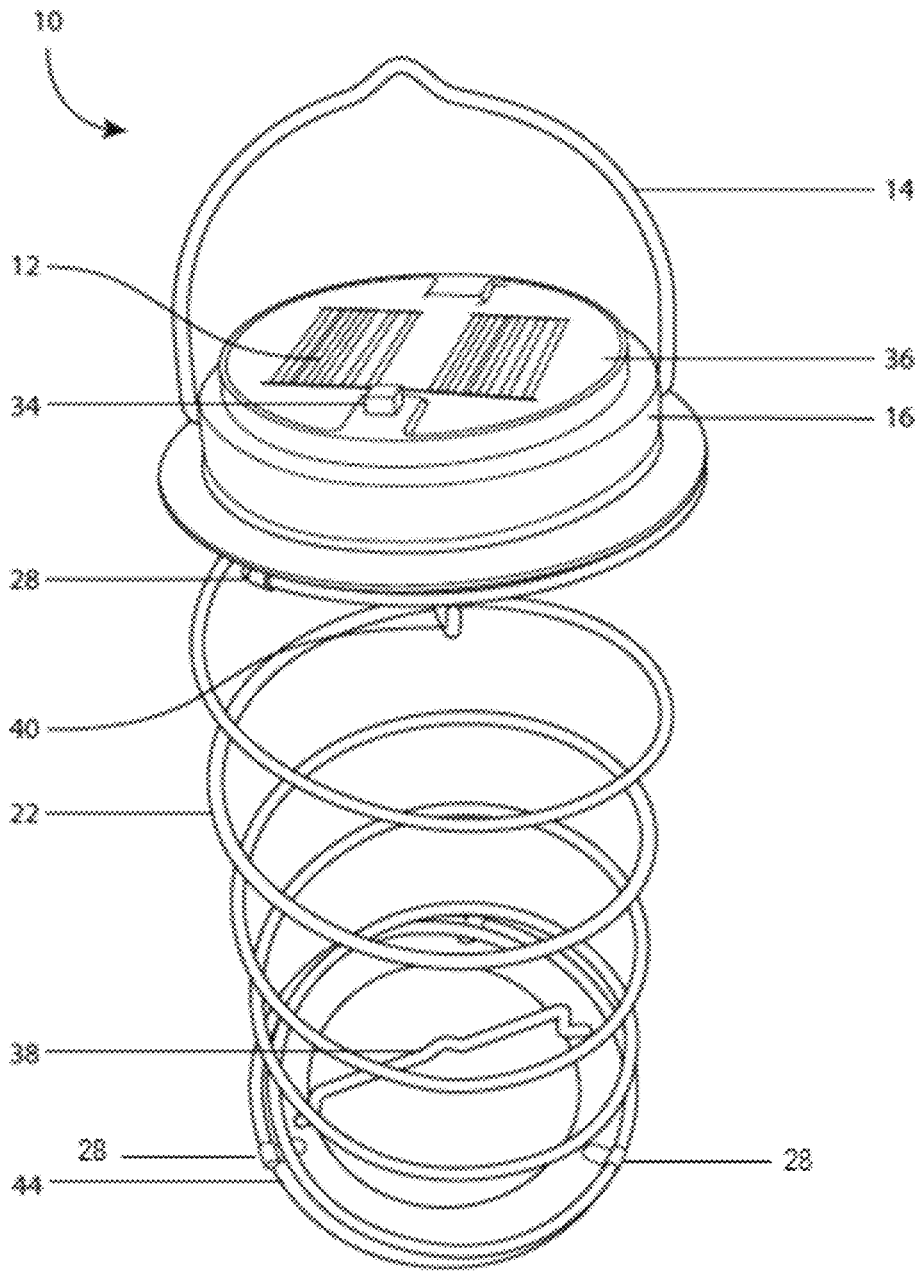
FIG. 2 illustrates a perspective view of the lantern of FIG. 1, with an exterior coil in the expanded position of the lantern.
Figure 3:
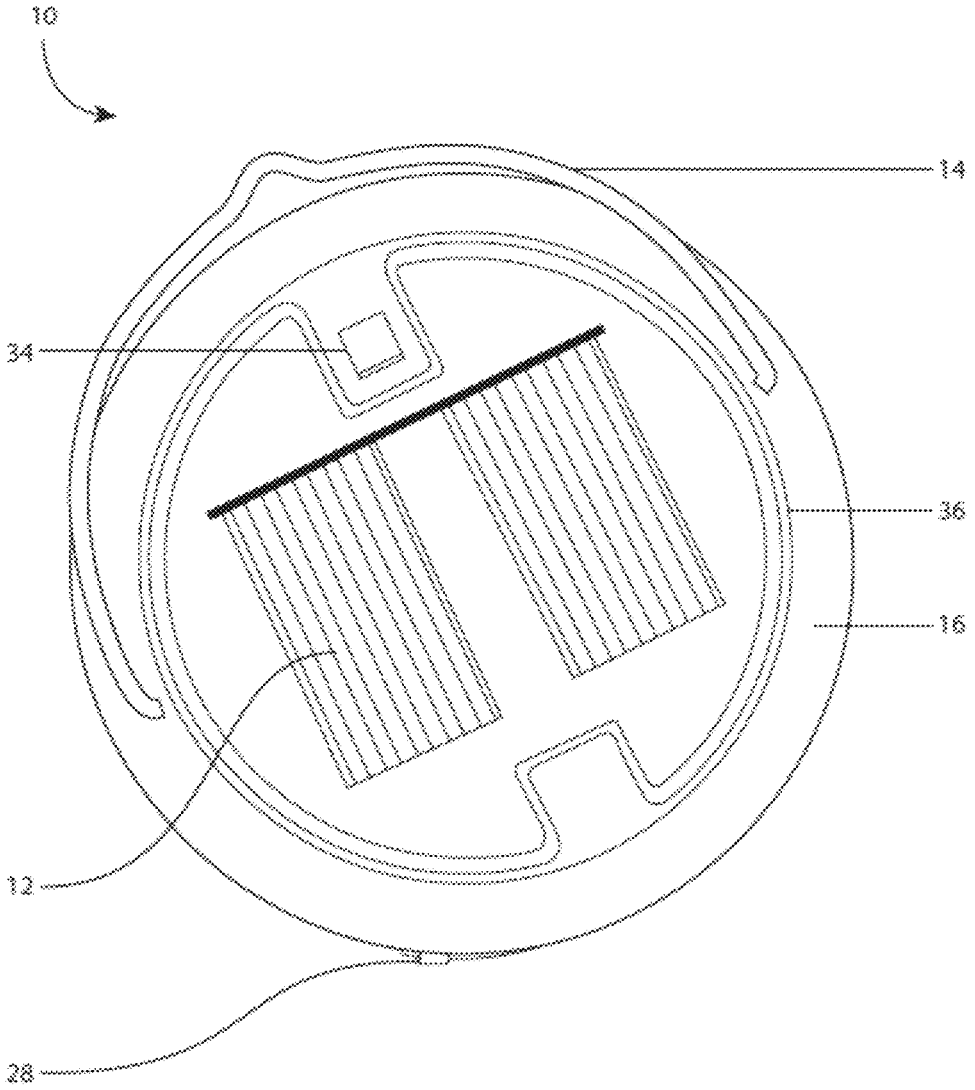
FIG. 3 illustrates a top view of the lantern of FIG. 1.
Figure 7:
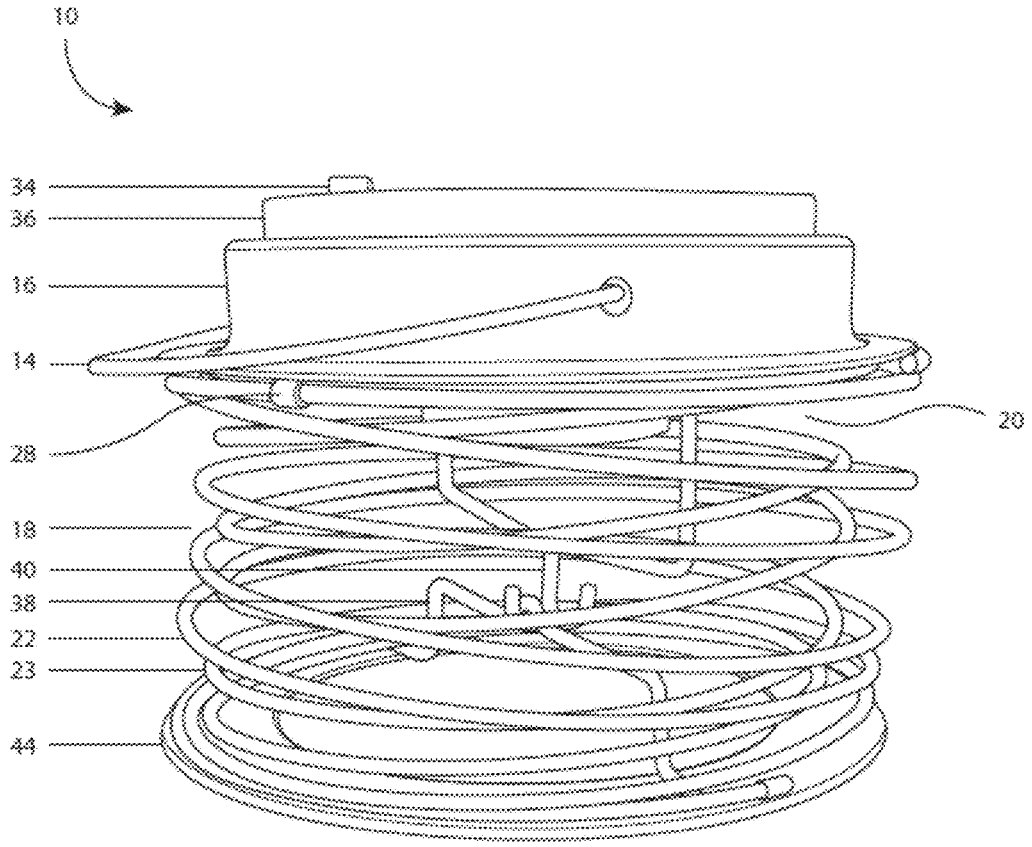

FIG. 7 FIG illustrates a side view of the lantern of FIG. 1 in a collapsed, storage position.

Figure 8:
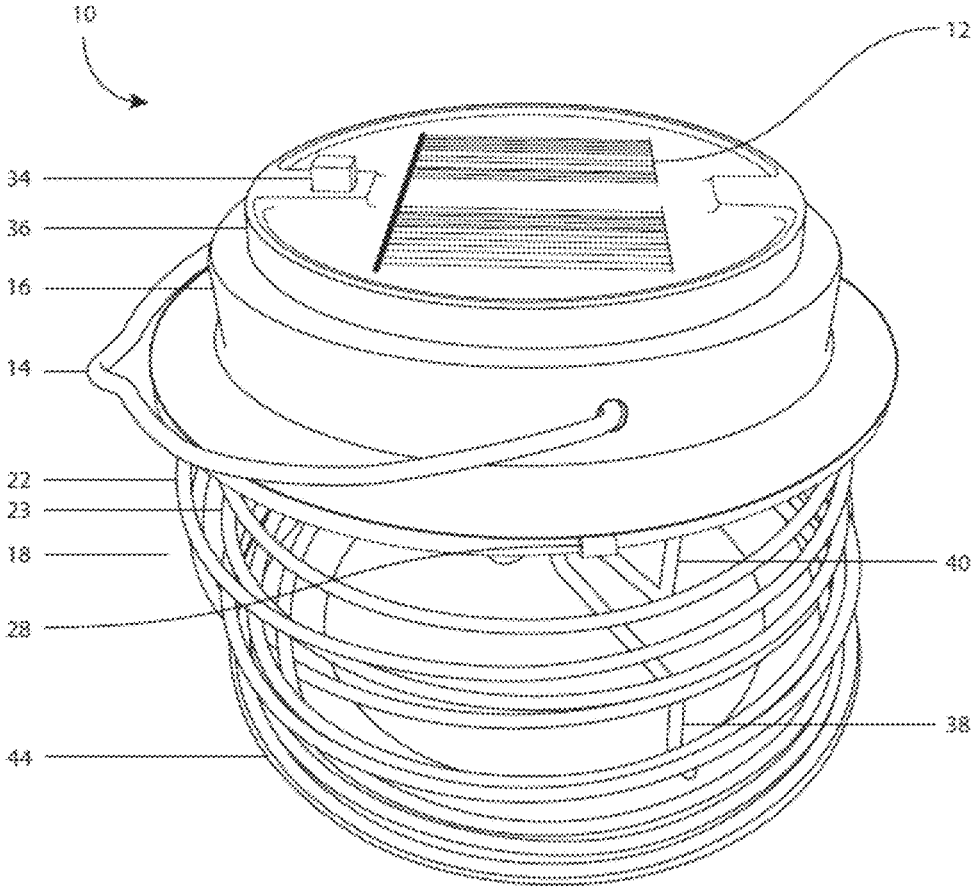

FIG. 8 illustrates a top perspective view of the lantern of FIG. 1 in a collapsed, storage position.

Figure 9:
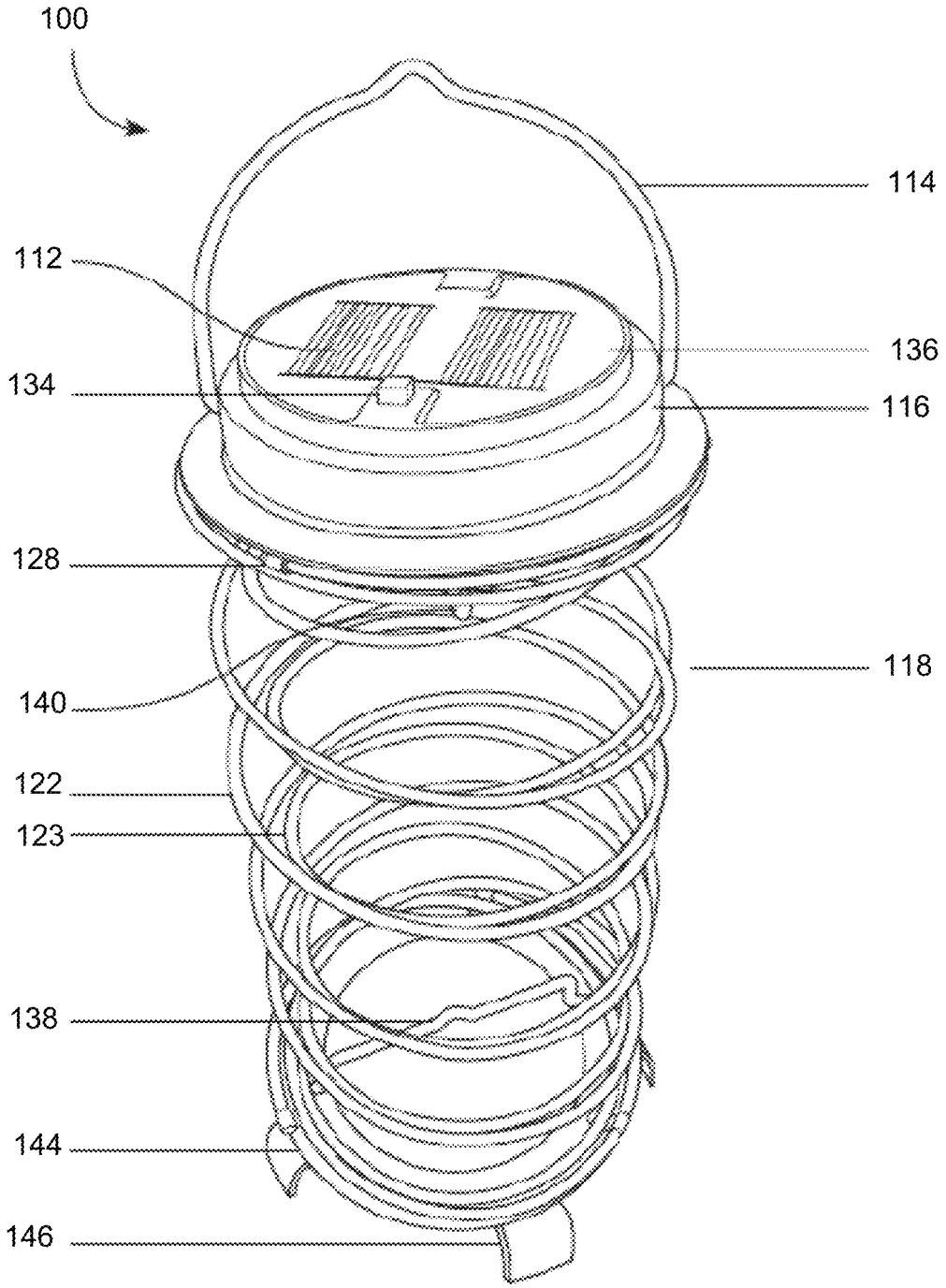

FIG. 9 illustrates a perspective view of the lantern having feet.

Figure 10:
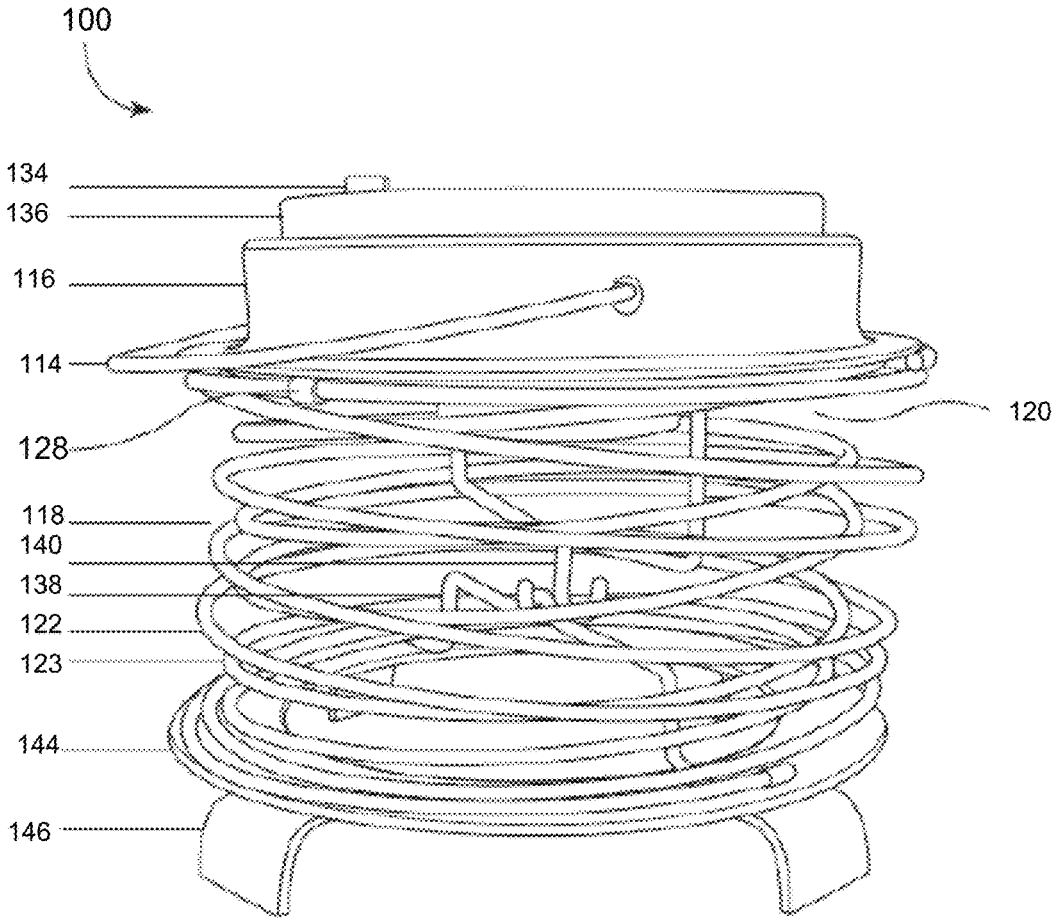

FIG. 10 illustrates a sideview of the lantern of FIG. 9 in a collapsed, storage position.

Figure 11:
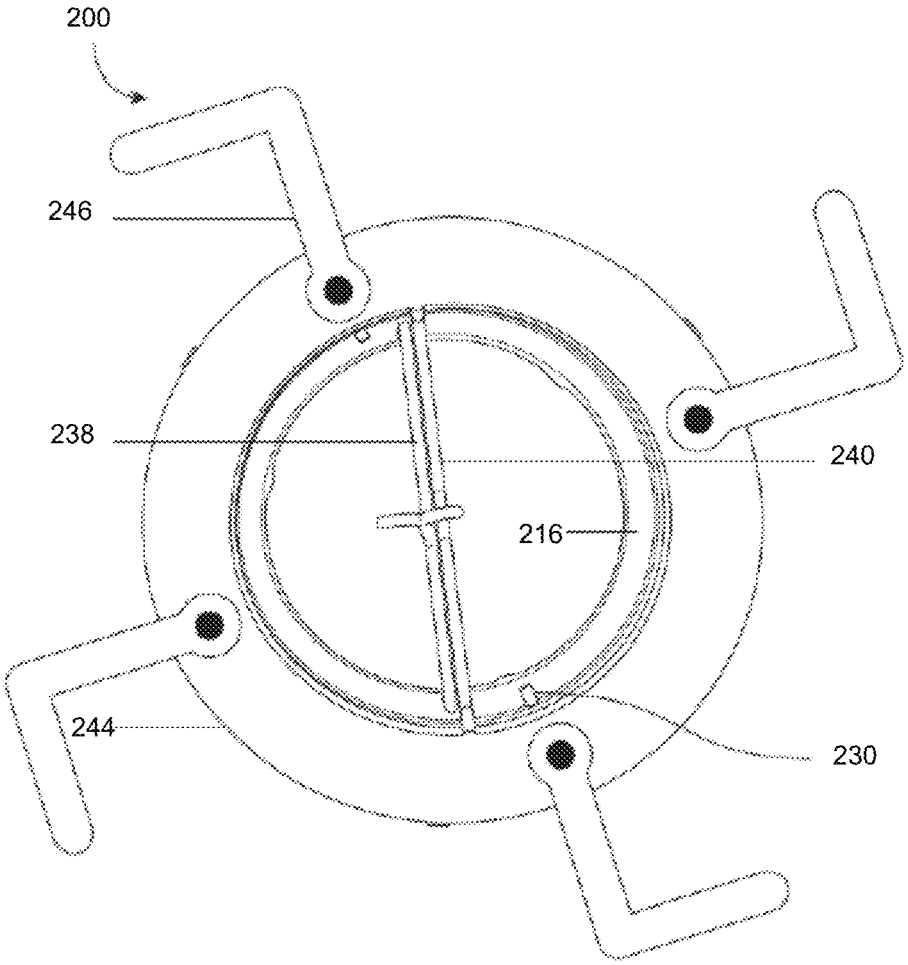
Figure 12:
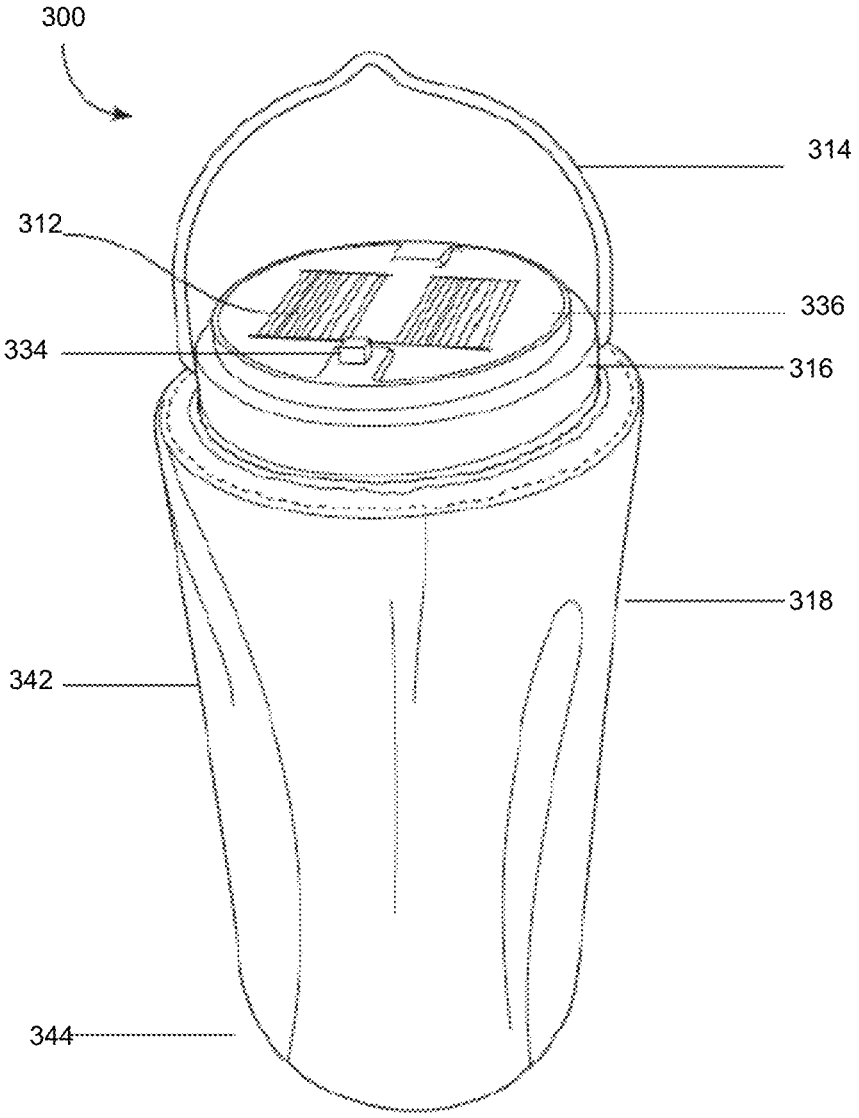

FIG. 11 illustrates a bottom view of a lantern having a base with pivotably moveable feet, in accordance with embodiments FIG. 12 illustrates a perspective view of a lantern with an interchangeable compliant shade in an expanded position, in accordance with embodiments.

DESCRIPTION

As illustrated in FIG. 1 through 12, in accordance with embodiments, a lantern, such as a solar-powered lantern 10, 200, 300 is to emit light. The solar-powered lantern 10, 200, 300 may be used for placement on an underlying support surface in a room of a home, or an open area of a lawn, patio, garden or the like. The solar-powered lantern 10, 200, 300 may also be hung in room of a home, or an open area of a lawn, garden or the like.

As illustrated in FIGS. 2, 3, 9, 10, and 12, the solar-powered lantern 10, 100, 300 includes at an upper region thereof a housing 16, 116, 316 and a handle member 14, 114, 314 connected thereto for rotational movement. The handle member 14, 114, 314 permits a user to move the solar-powered lantern 10, 100, 300 to different locations for placement on an underlying support. The handle member 14, 114, 314 may also permit a user to hang or otherwise suspend the solar-powered lantern 10, 100, 200, 300 from a suspension point.

As illustrated in FIGS. 4 through 6, 9, 10, and 12 a circuit container 36, 136, 336 is received in a cavity of the housing 16. The circuit container 36, 136, 336 at least one solar panel 12, 112, 312 and a light source 20, 120, 320 in electrical communication with the solar panels 12, 112, 312 to illuminate at least an interior space of the lantern 10. Although the solar-powered lantern 10, 100, 300 in accordance with embodiments may be powered via solar energy, embodiments are not limited thereto, and may encompass other alternative power sources that will fall within the spirit and scope of the principles of this disclosure.

In accordance with the embodiments, the lantern solar-powered 10, 100, 200, 300 may include an actuator 34, 134, 334 such as, for example, a power switch, is provided on the circuit container 36, 136, 336 to enable activation/deactivation of the light source 20. The circuit container 36, 136, 336 includes a circuit board 24 which is in electrical communication with the solar panel(s) 12, 112, 312 and the light source 20, and a battery 26 which is configured to be charged and discharged by the circuit board 24. In accordance with embodiments, the battery 26 may be a rechargeable battery. Alternatively, the circuit container 36, 136, 336 may include a photosensor to detect ambient light. The photosensor may trigger illumination of the light source 20 when ambient light falls below a predetermined or threshold level. The photosensor may discontinue the illumination when ambient light levels are high or upon the expiration of an internal or programed timer.

In accordance with embodiments, the light source 20 may comprise one or more light emitting diodes (LEDs) to emit light, for example, into the interior space of the solar-powered lantern 10, 100, 200, 300. Embodiments, however, are not limited thereto and may encompass other light sources that will fall within the spirit and scope of the principles of this disclosure, including lights which may extend into the interior space of the solar-powered lantern as defined by the coil structure 18, 118, 318 and the flexible shade member 342, or which may be mounted to or entwined with the coil structure 18, 118, 318.

In accordance with embodiments, the solar panel(s) 12, 112, 312 and the battery 26 generate electricity to the at least one light source 20. The circuit board 24 is configured to regulate the voltage passing to and from the battery 26 and the light source 20. The power switch can be used to start or halt the passage of electricity between the lighting components.

A lower region of the solar-powered lantern 10, 100, 200, 300 includes a support base 44, 144, 244, 344 which is arranged spaced apart in a longitudinal direction from the housing 16, 116, 316 to permit the free standing of the solar-powered lantern 10, 100, 200, 300 on a support surface.

In accordance with embodiments, the solar-powered lantern 10, 100, 200, 300 may be manipulated between an expanded, deployed position as illustrated in FIGS. 1, 9, 12 to a collapsed storage, position illustrated in FIGS. 7, 8 and 10. A self-erecting bias or coil structure 18, 118, 318 extends parallel to the longitudinal axis of the solar-powered lantern 10, 100, 300 between the housing 16, 116, 316 and the support base 44, 144, 344. The self-erecting coil structure 18, 118, 318 which is connected via connectors 28, 128 to the housing 16, 116, 316 and the support base 44, 144, 344 to define a frame that extends parallel to the longitudinal axis of the solar-powered lantern 10, 100, 200, 300. The coil structure 18, 118, 318 is multi-functional, for example, has a configuration which not only supports the weight of the housing 16, 116, 316 and solar light assembly, but also permits manipulation of the solar-powered lantern 10, 100, 200, 300 between a collapsed storage, position, and an expanded, deployed position. In accordance with embodiments, the expanded, deployed position is the normal, operating state of the solar-powered lantern 10, 100, 200, 300.

In accordance with embodiments, the self-deploying, self-erecting coil structure 18, 118 may have a structural configuration that includes an outer bias member 22, 122 comprising a helical coil spring and an inner bias member 23, 123 comprising a helical coil spring. The inner bias member 23, 123 may be concentrically arranged relative to the outer bias member 22, 122. Embodiments, however, are not limited thereto and may encompass other arrangements that will fall within the spirit and scope of the principles of this disclosure. The inner bias member 23, 123 is wound in a first direction (e.g., clockwise), and is configured to exert a bias force in a direction parallel to the longitudinal axis of the frame. The outer bias member 22, 122 is wound in a second direction counter to the first direction (e.g., counter-clockwise), and is configured to exert a bias force that is also parallel to the longitudinal axis of the frame.

The structural configuration and spatial positioning of the outer and inner bias members 22, 23 provides for a stable support for the frame of the solar-powered lantern 10 in the deployed position, and particularly permits the solar-powered lantern 10 to be easily compressed for shipping and storage. In accordance with embodiments, the coil structure 18 may be composed of metal, wood, bamboo, plastic, or any reasonable composite thereof. Embodiments, however, are not limited thereto and may encompass other materials with appropriate properties that will fall within the spirit and scope of the principles of this disclosure.

As illustrated in FIG. 7, the solar-powered lantern 10 in accordance with embodiments may further include a connection assembly to establish a connection/disconnection point between the housing 16 and the support base 44. The connection assembly comprises a hook or latch member 40 arranged at the housing 16, and a bar member 38 arranged at the support base 44. The bar member 38 extends in a direction transverse to the longitudinal axis of the frame. In use, the bar member 38 may be engaged by the latch member 40 in a connection position in which the solar-powered lantern 10 is held in the collapsed storage, state. The bar member 38 may be disengaged from the latch member 40 in the disconnection position in which the solar-powered lantern 10 self-deploys/self erects into the expanded, deployed state.

The connection/disconnection point is located at the interior space of the lantern 10 defined by the coil structure 18, the shade member 42, or the coil structure 18 and the shade member 42. In use, the connection assembly may be manipulated between a connection position in which the housing 16 is connected to the support base 44 to maintain the lantern 10 in the collapsed storage, position, and a disconnection position in which the housing 16 is disconnected from the support base 44 to place the lantern 10 in the expanded, deployed position. Embodiments however are not limited thereto and may encompass other latching mechanisms that fall within the spirit and the scope of this disclosure.

As illustrated in FIGS. 9 and 10, the support base 144 in accordance with embodiments may include a plurality of circumferentially spaced apart feet members 146 to provide for wider base support, and thus, greater stability in preventing the solar-powered lantern 100 from falling over when in a deployed operating state. In accordance with embodiments, the feet members 146 may be mechanically connected to the support base 144, or alternatively, the support base 144 and feet members 146 may be constructed as a single unit.

As illustrated in FIG. 11, alternatively, each feet member 246 may be pivotably connected at a pivot axis to the support base 244 for manipulation between an inwardly-directed pivot position within the outer periphery of the support base 244, and an outwardly-directed pivot position outside of the periphery of the support base 244. Additionally or alternatively, embodiments may encompass feet which may slide radially outward from the support base 244.

As illustrated in FIG. 12, a compliant and interchangeable shade member 342 is arranged concentrically with respect to the coil structure 318 to cover the structural components of the coil structure 318. The shade member 42 is configured to extend between the housing 316 and the support base 344 for removable connection thereto via, for example, a form fit connection. The shade member 342 is configured to act as a tension member to restrict the overall length of the frame when the solar-powered lantern 300 is in the expanded, deployed position. The shade member 342, therefore, works in conjunction with the coil structure 318 to created stability of the solar-powered lantern in the deployed position and serves to prevent the tipping over of the solar-powered lantern 300 when the solar-powered lantern 300 is placed in a deployed position.

The shade member 342 may have any geometric shape that will falls within the spirit and scope of the principles of this disclosure. The shade member 342 may be composed of a flexible and compliant material. Such a material, for example, may comprise a fabric material. Embodiments, however, are not limited thereto and may encompass other materials that will fall within the spirit and scope of the principles of this disclosure. Although the shade member 342 may have an ornamental or decorative appearance, embodiments are not limited thereto. For example, the shade member 342 in accordance with embodiments may be non-ornamental or non-decorative in appearance.

Additional Notes and Examples:

Example One may include a solar lantern, comprising: a housing: at least one solar panel arranged at the housing; at least one light source in electrical communication with the at least one solar panel; a support base spaced from the housing; a self-deploying coil structure extending between and connected to the housing and the support base to define a self-deploying frame, and which is configured to permit manipulation of the solar lantern between a collapsed storage, position and an expanded, deployed position, the self-deploying coil structure having an inner coil member which is coiled in a first direction relative to the longitudinal axis of the frame, and an outer coil member which is coiled in a second direction opposite to the first direction; and a compliant shade member extending between and removeably connected to the housing and the support base, the compliant shade member being configured to act as a tension member to restrict the length of the frame when the solar lantern is in the expanded, deployed position.

Example Two may include the solar lantern of Example One, further comprising a circuit board in electrical communication with the at least one solar panel and the at least one light source; and a rechargeable battery arranged in the housing and in electrical communication with the circuit board, and which is configured to be charged and discharged by the circuit board.

Example Three may include the solar lantern of Example One, wherein the at least one light source comprises at least one LED.

Example Four may include the solar lantern of Example One, wherein the inner coil member and the outer coil member is configured to exert a bias force in a same direction parallel to the longitudinal axis of the frame.

Example Five may include the solar lantern of Example One, further comprising a connection assembly configured for establishing a connection/disconnection point between the housing and the support base at an interior space of the solar lantern defined at least partially by the self-erecting coil structure.

Example Six may include the solar lantern of Example One, further comprising a connection assembly configured for manipulation between: a connection position in which the housing is connected to the support base to place the solar lantern in the collapsed storage, position; and a disconnection position in which the housing is disconnected from the support base to place the solar lantern in the expanded, deployed position.

Example Seven may include the solar lantern of Example Six, wherein the connection position and the disconnection position are at an interior space of the lantern defined at by the self-erecting coil structure and the flexible shade member.

Example Eight may include the solar lantern of Example Six, wherein the connection assembly comprises: a latch member arranged at the housing; and a bar member arranged at the support base and configured for engagement by the latch member in the connection position.

Example Nine may include the solar lantern of Example One, further comprising movable feet members which may be pivotably affixed at a pivot axis to the support base, or slidably connected to support base, for manipulation between a retracted, storage position and an extended, deployed position.

Example Ten may include a lantern, comprising: a housing having a light source; a support base; a self-erecting bias structure defining a self-erecting frame, the self-erecting bias structure being configured to permit manipulation of the lantern between a collapsed, storage, position and an expanded, deployed position, and to exert a bias force in a direction parallel to the longitudinal axis of the frame; and a compliant shade extending between and removeably connected to the housing and the support base, the compliant shade being configured to act as a tension member to restrict the length of the frame when the lantern is in the expanded, deployed position.

Example Eleven may include the lantern of Example Ten, further comprising: a solar panel arranged at the housing; a circuit board in electrical communication with the solar panel and the light source; and a rechargeable battery in electrical communication with the circuit board, and which is configured to be charged and discharged by the circuit board.

Example Twelve may include the lantern of Example Ten, wherein the light source comprises at least one LED.

Example Thirteen may include the lantern of Example Ten, wherein the self-erecting bias structure comprises at least one coil spring.

Example Fourteen may include the lantern of Example Ten, further comprising a connection assembly configured for establishing a connection/disconnection point between the housing and the support base at an interior space of the lantern defined by the self-erecting bias structure and the shade member.

Example Fifteen may include the lantern of Example Fourteen, wherein the connection/disconnection point is located at an interior space of the lantern defined by the self-erecting bias structure and the shade member.

Example Sixteen may include the lantern of Example Ten, further comprising a connection assembly configured for manipulation between: a connection position in which the housing is connected to the support base to place the lantern in the collapsed storage, position; and a disconnection position in which the upper housing is disconnected from the support base to place the lantern in the expanded, deployed position.

Example Seventeen may include the lantern of Example Sixteen, wherein the connection position and the disconnection position are at an interior space of the lantern defined at least partially by the self-erecting bias structure.

Example Eighteen may include the solar lantern of Example Sixteen, wherein the connection assembly comprises: a latch member arranged at the housing; and a bar member arranged at the lower support base and configured for engagement by the latch member in the connection position.

Example Nineteen may include the solar lantern of Example Ten, further comprising feet members pivotably affixed at a pivot axis to the support base for manipulation between a retracted, storage position and an extended, deployed position.

Example Twenty may include a lantern, comprising: a housing having a light source; a support base; a frame structure defining a self-deploying frame which connects the housing and the support base, the frame structure being configured to permit manipulation of the lantern between a collapsed, storage, position and an expanded, deployed position, the frame structure having biased members configured to produce an expansion force parallel to the longitudinal axis of the lamp; and a compliant shade member extending between the housing and the support base, the shade being configured to act as a tension member to restrict the length of the frame when the lantern is in the expanded, deployed position.

The terms "coupled," "attached," or "connected" may be used herein to refer to any type of relationship, direct or indirect, between the components in question, and may apply to electrical, mechanical, fluid, optical, electromagnetic, electromechanical or other connections. In addition, the terms "first," "second," etc. are used herein only to facilitate discussion, and carry no particular temporal or chronological significance unless otherwise indicated.

Those skilled in the art will appreciate from the foregoing description that the broad techniques of the embodiments can be implemented in a variety of forms. Therefore, while the embodiments have been described in connection with particular examples thereof, the true scope of the embodiments should not be so limited since other modifications will become apparent to the skilled practitioner upon a study of the drawings, specification, and following claims.

What is claimed is:

1. A solar-powered lantern, comprising:

a housing:

at least one solar panel;

at least one light source in electrical communication with the at least one solar panel;

a support base spaced from the housing;

a self-deploying coil structure extending between and connected to the housing and the support base to define a frame, the self-deploying coil structure being configured to permit movement of the solar lantern between a collapsed, storage position and an expanded position, the self-deploying coil structure having an inner coil member which is coiled in a first direction relative to the longitudinal axis of the frame, and an outer coil member which is coiled in a second direction opposite to the first direction;

a compliant shade member extending between and removeably connected to the housing and the support base, the compliant shade member being configured to act as a tension member to restrict the length of the frame when the solar lantern is in the expanded position; and a connection assembly that includes a latch member and a bar member to place the lantern in the collapsed storage position and in the expanded position, the connection assembly being configured for movement between a connection position in which the latch member engages the bar member to thereby connect the housing to the support base, and a disconnection position in which the latch member disengages the bar member to thereby disconnect the housing from the support base, wherein the connection position and the disconnection position are at an interior space of the lantern defined at least partially by the self-erecting bias structure.

2. The solar lantern of claim 1, further comprising:

a circuit board in electrical communication with the at least one solar panel and the at least one light source; and a rechargeable battery arranged in the housing and in electrical communication with the circuit board, and which is configured to be charged and discharged by the circuit board.

3. The solar lantern of claim 1, wherein the at least one light source comprises at least one LED.

4. The solar lantern of claim 1, wherein the inner coil member and the outer coil member is configured to exert a bias force in a same direction parallel to the longitudinal axis of the frame.

5. The solar lantern of claim 1, further comprising movable feet members which may be pivotably affixed at a pivot axis to the support base, or slidably connected to support base, for movement between a retracted, storage position and an extended position.

6. A lantern, comprising:

a housing having a light source;

a support base;

a bias structure defining a self-deploying frame, the bias structure being configured to permit movement of the lantern between a collapsed, storage position and an expanded position, the bias structure also being configured to exert a bias force in a direction parallel to the longitudinal axis of the frame;

a shade member extending between and removeably connected to the housing and the support base, the shade member being configured to act as a tension member to restrict the length of the self-deploying frame when the lantern is in the expanded position; and a connection assembly that includes a latch member arranged at the housing and a bar member arranged at the support base to extend in a direction transverse to the longitudinal axis of the frame, the connection assembly being configured for movement between a connection position in which the latch member engages the bar member to thereby connect the housing to the support base and place the lantern in the collapsed storage position, and a disconnection position in which the latch member disengages the bar member to thereby disconnect the housing from the support base and place the lantern in the expanded position, wherein the connection position and the disconnection position are at an interior space of the lantern defined at least partially by the self-erecting bias structure.

7. The lantern of claim 6, further comprising:

a solar panel arranged at the housing;

a circuit board in electrical communication with the solar panel and the light source; and a rechargeable battery in electrical communication with the circuit board, and which is configured to be charged and discharged by the circuit board.

8. The lantern of claim 6, wherein the light source comprises at least one LED.

9. The lantern of claim 6, wherein the bias structure comprises at least one coil spring.

10. The lantern of claim 6, further comprising feet members pivotably affixed at a pivot axis to the support base for movement between a retracted, storage position and an extended position.

11. A lantern, comprising:

a housing having a light source;

a support base;

a frame structure defining a self-deploying frame which connects the housing and the support base, the frame structure being configured to permit movement of the lantern between a collapsed, storage position and an expanded position, the frame structure having bias members configured to produce an expansion force parallel to the longitudinal axis of the lamp, the bias members including an inner bias member which is coiled in a first direction relative to the longitudinal axis of the frame structure, and an outer bias member concentrically arranged relative to the inner bias member, and which is coiled in a second direction opposite to the first direction;

a compliant shade member extending between the housing and the support base, the compliant shade member being configured to act as a tension member to restrict the length of the frame when the lantern is in the expanded position; and a connection assembly that includes a latch member arranged at the housing and a bar member arranged at the support base to extend in a direction transverse to the longitudinal axis of the frame, the connection assembly being configured for movement between a connection position in which the latch member engages the bar member to thereby connect the housing to the support base and place the lantern in the collapsed, storage position, and a disconnection position in which the latch member disengages the bar member to thereby disconnect the housing from the support base and place the lantern in the expanded position, wherein the connection position and the disconnection position are at an interior space of the lantern defined at least partially by the self-erecting bias structure.

* * * * *